US008179223B2

(12) United States Patent
Ohsawa

(10) Patent No.: US 8,179,223 B2
(45) Date of Patent: May 15, 2012

(54) SHEET TYPE TRANSFORMER AND DISCHARGE LAMP LIGHTING APPARATUS

(75) Inventor: Takashi Ohsawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 162 days.

(21) Appl. No.: 12/441,493

(22) PCT Filed: Jun. 20, 2007

(86) PCT No.: PCT/JP2007/062448

§ 371 (c)(1), (2), (4) Date: Mar. 16, 2009

(87) PCT Pub. No.: WO2008/053613

PCT Pub. Date: May 8, 2008

(65) Prior Publication Data

US 2009/0289750 A1 Nov. 26, 2009

(30) Foreign Application Priority Data

Oct. 31, 2006 (JP) ..... 2006-296321

(51) Int. Cl.

| | |
|---|---|
| ***H01F 17/04*** | (2006.01) |
| ***H01F 21/02*** | (2006.01) |
| ***H01F 27/28*** | (2006.01) |
| ***H01F 27/24*** | (2006.01) |

(52) U.S. Cl. ..... 336/221; 336/145; 336/182; 336/192; 336/220; 336/222; 336/212

(58) Field of Classification Search ..... 336/192, 336/200–222, 232, 145, 182

See application file for complete search history.

(56) References Cited

U.S. PATENT DOCUMENTS

| | | | | |
|---|---|---|---|---|
| 2,030,648 | A * | 2/1936 | Meissner | 381/397 |
| 3,507,039 | A * | 4/1970 | Craige | 29/605 |
| 4,047,138 | A * | 9/1977 | Steigerwald | 336/100 |
| 4,769,625 | A * | 9/1988 | Meindl | 336/65 |
| 5,268,663 | A * | 12/1993 | Takeuti et al. | 336/212 |
| 5,521,573 | A * | 5/1996 | Inoh et al. | 336/180 |
| 5,959,521 | A * | 9/1999 | Kohmura et al. | 336/198 |
| 6,025,770 | A * | 2/2000 | Okamoto et al. | 336/83 |
| 6,054,914 | A * | 4/2000 | Abel et al. | 336/200 |
| 6,075,431 | A * | 6/2000 | Honma | 336/180 |
| 6,084,354 | A * | 7/2000 | Kohmura et al. | 315/57 |
| 6,914,508 | B2 * | 7/2005 | Ferencz et al. | 336/200 |
| 7,277,001 | B2 * | 10/2007 | Mizushima et al. | 336/192 |
| 2002/0171527 | A1 * | 11/2002 | Minami et al. | 336/182 |

FOREIGN PATENT DOCUMENTS

| | | | |
|---|---|---|---|
| JP | 59-56727 | U | 4/1984 |
| JP | 62-257709 | A | 11/1987 |
| JP | 3-234008 | A | 10/1991 |
| JP | 5-13027 | U | 2/1993 |
| JP | 6-112065 | A | 4/1994 |
| JP | 6-342726 | A | 12/1994 |

(Continued)

*Primary Examiner* — Elvin G Enad
*Assistant Examiner* — Mangtin Lian
(74) *Attorney, Agent, or Firm* — Birch, Stewart, Kolasch & Birch, LLP

(57) ABSTRACT

A sheet type transformer includes a primary winding 1 formed in the shape of a flat plate; and a secondary winding 6 wound around an axis perpendicular to the face of the primary winding 1, wherein the end 6*a* of the secondary winding 6 on the radially central side thereof is drawn out in the direction perpendicular to the face of the primary winding 1.

17 Claims, 12 Drawing Sheets

FOREIGN PATENT DOCUMENTS

| | | | | |
|---|---|---|---|---|
| JP | 8-306539 | A | | 11/1996 |
| JP | 8-316040 | A | | 11/1996 |
| JP | 8-316060 | A | | 11/1996 |
| JP | 9-199347 | A | | 7/1997 |
| JP | 10-12453 | A | | 1/1998 |
| JP | 10294232 | A | * | 11/1998 |
| JP | 10294232 | A | * | 11/1998 |
| JP | 2001-35730 | A | | 2/2001 |
| JP | 2004-207375 | A | | 7/2004 |
| JP | 2005-57309 | A | | 3/2005 |
| JP | 2006-156559 | A | | 6/2006 |
| JP | 2006156559 | A | * | 6/2006 |
| JP | 2006156559 | A | * | 6/2006 |
| JP | 2006-245427 | A | | 9/2006 |

* cited by examiner (a)

(b)

SHEET TYPE TRANSFORMER AND DISCHARGE LAMP LIGHTING APPARATUS

TECHNICAL FIELD

The present invention relates to a sheet type transformer and a discharge lamp lighting apparatus using the same.

BACKGROUND ART

In recent years, size reduction, thickness reduction, and cost reduction in a variety of transformers have been promoted. The same matters are required of a transformer designed for a high voltage as well. Sheet type transformers are advantageous as a low-power thin-type transformer to be used in small apparatuses. A sheet type transformer is made up by, for example, superposing a secondary coil formed by winding an insulated conductive wire in the form of a spiral on a primary coil formed by stamping a sheet of conductive plate into a spiral shape, and fixing the secondary coil on the first coil with an adhesive. Such sheet type transformers are disclosed in the following Patent Documents 1, 2, and 3. Further, miniaturized transformers designed for a high voltage are disclosed in the following Patent Documents 4 and 5, for example.

The sheet type transformer disclosed in Patent Document 1 is made up by forming one winding with a dielectric-coated spiral conductive wire and the other winding by use of a pattern of a printed circuit board, and further fixing both of the windings to each other with a tape. However, in the sheet type transformer disclosed in Patent Document 1, the conductive wire wound in a spiral form is covered with an insulating layer. In a transformer for generating a high voltage, the dielectric-coated layer of a conductor wire for securing a withstand voltage against a high voltage at the output could be thicker, and thus the transformer for generating a high voltage that requires a large number of coil turns in a secondary winding thereof could be larger in size.

In the sheet type transformer disclosed in Patent Document 2, one winding is composed of a three-layer-insulated spiral conductor wire, while the other winding is composed by stamping a conductive plate, and the one winding is superposed on the other. However, in the sheet type transformer disclosed in Patent Document 2, the conductor wire wound in a spiral form is covered with three insulating layers. When the transformer is used as transformers for generating a high voltage, the withstand voltage of the three insulating layers thereof determines the limit of the withstand voltage of the transformer.

In the sheet type transformer disclosed in Patent Document 3, a primary winding and a secondary winding are wounded in a uniplanar spiral shape where the primary winding is internally disposed and the secondary winding is externally disposed, and the lead wires of both the windings are disposed in different positions. However, in the sheet type transformer disclosed in Patent Document 3, the withstand voltage between the primary winding and the secondary winding is secured by the withstand voltage of each conductor wire, and thus the sheet type transformer is inapplicable to transformers generating a high voltage exceeding the withstand voltage of the conductor wire.

The transformer disclosed in Patent Document 4 is a step-up transformer, a uniplanar bobbin has a primary winding wound on the inside thereof and has a secondary winding wound on the outside thereof, and the lead wire of each winding is embedded in a slit which is provided in the bobbin and used for each winding with an insulating adhesive. In the step-up transformer disclosed in Patent Document 4, the insulating adhesive embedding the lead wire therein serves the function of the insulating member securing the withstand voltage, and the withstand voltage of the transformer is determined by the thickness of the adhesive. However, the step of filling the adhesive thereinto involves some uncertain factors in quality such as the remainder of voids and the excessive or deficient injection amounts of the adhesive. Therefore, in order to provide the transformer with a sufficient withstand voltage, the adhesive has to be filled to a substantial thickness. This requires a deeper slit for forming the filling depth, a large thickness of the base of the bobbin (causing a larger size thereof), and a large amount of the adhesive to be filled as a matter of course, thus making it difficult to secure the stable quality. For this reason, the structure of such a step-up transformer is inapplicable to compact high-voltage generating transformers.

The transformer disclosed in Patent Document 5 is a high-voltage transformer, and has a structure where a uniplanar bobbin (base) has a primary winding wound on the outside thereof and has a secondary winding wound on the inside thereof, the lead wire of the secondary winding is routed down to the groove (lead wire drawing-out groove) provided in the bobbin and is drawn out to a terminal, and the partition of an upper guard is to be fit to the partition of the base enclosing the secondary winding. In the transformer, the magnitude of the withstand voltage is determined by the depth of the groove where the lead is routed down and the creeping distance where the partition provided on the base overlaps with the partition provided on the guard. If those depth and distance are increased, the transformer is increased in size as a matter of course. Therefore, the structure of such a transformer is inapplicable to compact high-voltage transformers.

Patent Document 1: JP-A-1996-316040
Patent Document 2: JP-A-1996-306539
Patent Document 3: JP-A-1997-199347
Patent Document 4: JP-A-1994-112065
Patent Document 5: JP-A-1994-342726

In view of the above-cited documents, there should be developed a compact transformer designed for a high-voltage satisfying the following requirements:

the degree of coupling between a primary winding and a secondary winding is enhanced (the energy of the primary winding is efficiently transmitted to the secondary winding);

the cross-sectional areas of wire materials of the primary winding and the secondary winding are sufficiently large (the loss at the time of energizing of the transformer is reduced by reducing the electric resistance thereof); and the transformer is manufactured at low cost (the materials are inexpensive, the number of parts is small, and the manufacturing process is simple).

The above-described sheet type transformer is effective in performing a compact and thickness-reduced transformer. However, when a transformer designed for a high voltage is built by use of a sheet type transformer, there are the following problems because of a slimness of the sheet type transformer as a feature:

It is difficult to ensure insulating properties and withstand voltages in an area where a high potential difference is generated between starting and ending points of a winding for a high voltage; and It is difficult to obtain the insulating properties and the withstand voltages between the members such as winding and terminal on the low voltage side, and the area where a high voltage is generated.

The present invention provides a sheet type transformer with a simple structure, causing no damage to its slimness, and securing high insulating properties to address a high voltage.

DISCLOSURE OF THE INVENTION

The sheet type transformer according to the present invention includes a primary winding formed in the shape of a flat plate; and a secondary winding wound around an axis perpendicular to the face of the primary winding, wherein the end of the secondary winding on the central side in a radial direction thereof is drawn out in a direction perpendicular to the face of the primary winding.

According to the present invention, it is arranged that the end on the high voltage side of the secondary winding is drawn out from the central side in the radial direction of the winding, and thus it becomes easy to ensure not only a high withstand voltage but also excellent insulating properties. The primary winding is formed in a tabular shape, while the secondary winding bobbin can be formed or molded integral with the primary winding, thus enabling size reduction in the axial direction thereof. Further, winding works thereof becomes easy, which can reduce the manufacturing cost. The primary and secondary windings and cores can be disposed in close proximity to each other, thus giving improved electric characteristics (coupling) thereof. Since the secondary winding is formed by winding a conductor wire without employing a sheet-shaped winding, a winding ratio between the secondary and primary windings can be increased, which facilitates generation of a high voltage.

According to the present invention, a spool for the secondary winding wound thereon, which is opposed to the tabular primary winding wide in the radial direction, can be formed in a form where the spool has a small width and a large depth. Thus, the large insulation distance (creeping distance) corresponding to the radius of the secondary winding scrolled into multi layers (the depth of the groove wound by the secondary winding) can be secured with respect to a potential difference between the central side of the secondary winding and the outer peripheral portion thereof. This enables the transformer having a simple structure to generate a high voltage.

BEST MODE FOR CARRYING OUT THE INVENTION

Preferred embodiments of the present invention will now be described with reference to the accompanying drawings in order to explain the present invention in more detail.

First Embodiment

Figure 1:
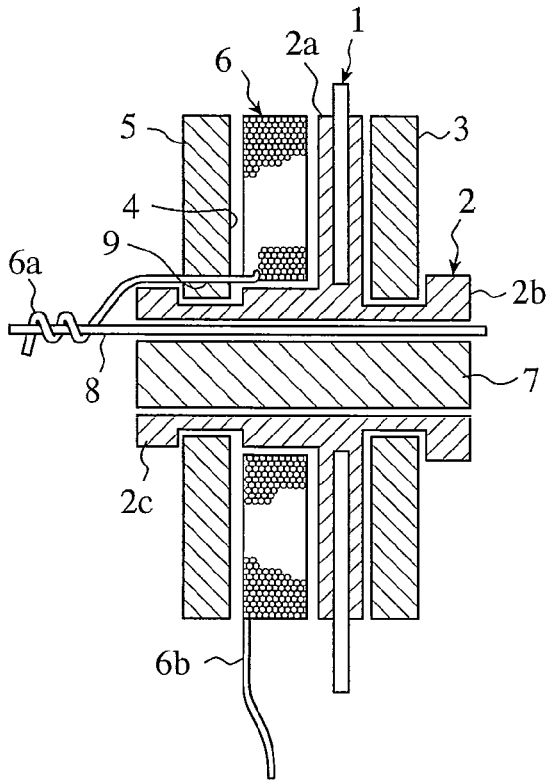
FIG. 1 is a longitudinal cross-sectional view of a sheet type transformer of the first embodiment of the present invention.
Figure 2:
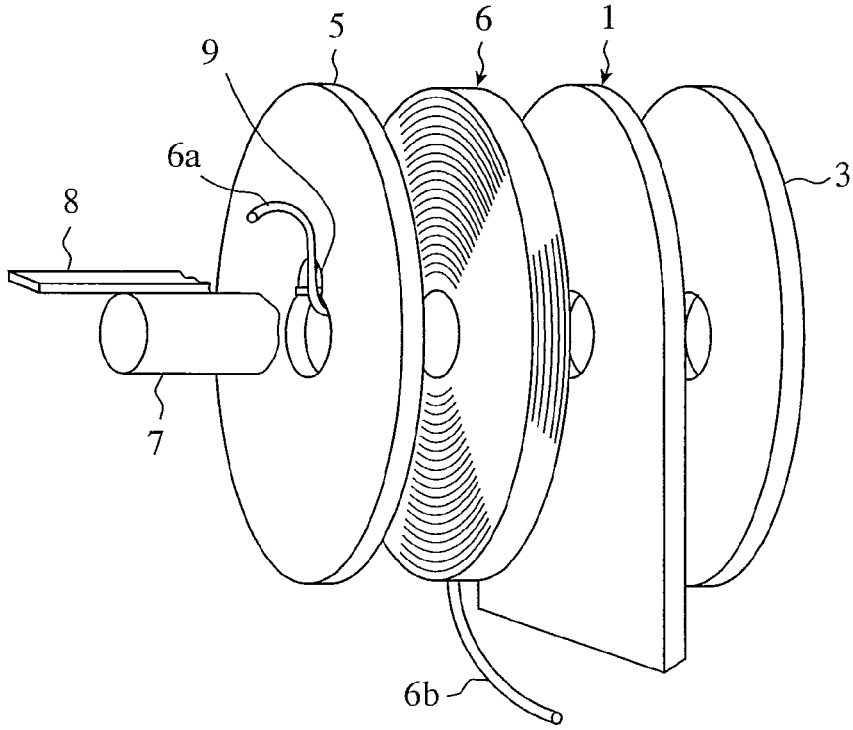
FIG. 2 is an exploded perspective view of the sheet type transformer of the first embodiment of the present invention.

The first embodiment of the present invention will next be discussed by reference to the drawings in detail. FIG. 1 shows in cross-sectional view a sheet type transformer of the first embodiment, and FIG. 2 shows the structural members thereof with a bobbin removed in a disassembled state. The sheet type transformer of the first embodiment has the most basic structure embodying the present invention.

The central portion of a tabular primary winding 1 is embedded within the outer peripheral portion of a cylindrical bobbin 2. The tabular primary winding 1 is integrated into the bobbin 2 in an embedded-in-the-bobbin condition by an injection molding or the like such that a tabular primary winding 1 is set in a metal mold of the injection molding and then a resin is injected into the metal mold. In an axial direction of the bobbin 2, one side of a primary-winding embedded portion 2*a* of the primary winding 1 is provided with a first plate core 3, and the other side thereof is provided with a second plate core 5 having a space (spool) 4 placed therebetween, which serves the function of a portion housing a secondary winding thereon. Those plate cores 3, 5 are combined together to be integrally held through the bobbin 2 when the bobbin 2 is molded while embedding the primary winding 1 therein, and the plate cores form part of the bobbin 2. In order to position the plate cores 3, 5 on the bobbin 2, flanges 2*b*, 2*c* are formed at both ends of the bobbin 2.

A secondary winding 6 is formed by winding conductor wire about the central stem of the bobbin 2 in the space (spool) 4 between the primary-winding embedded portion 2*a* and the second plate core 5 of the bobbin 2. Conductor wire of round cross-section is used as the conductor wire of the secondary winding 6. End 6*a* on the radially central side (on the central stem side of the bobbin 2) of the secondary winding 6 that is the end (serving as a winding start at a coil-winding work) on the high voltage side of the secondary winding 6 is not drawn out to the side of the primary winding 1, nor drawn out outwardly radially of the secondary winding 6, but the end 6*a* is led to the side opposite from the primary winding 1, and further it is drawn out to the outside of the second plate core 5. End 6*b* on the low voltage side of the secondary winding 6 that is the other end thereof is radially outwardly drawn out.

A cylindrical central core 7 is inserted in the central portion of the bobbin 2. A plate-shaped terminal 8 is inserted between the central core 7 and the bobbin 2. The end 6*a* on the high voltage side of the secondary winding 6 drawn out to the outside of the second plate core 5 is connected to the terminal 8. The second plate core 5 is provided with a lead hole 9 for drawing out the end 6*a* of the secondary winding 6.

Figure 3:
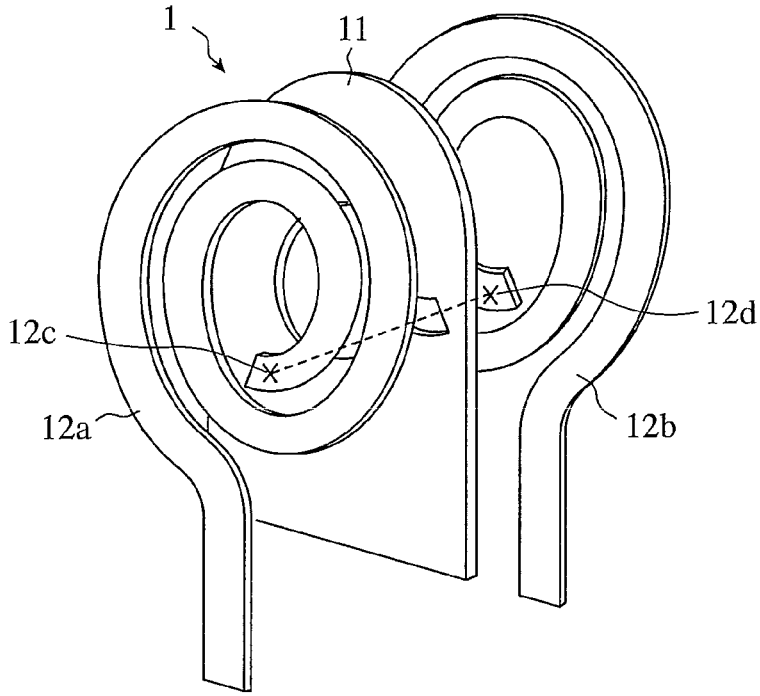
FIG. 3 is an exploded perspective view of one example of a primary winding having a flat-plate shape.

One example of the tabular primary winding 1 is shown in FIG. 3. The primary winding 1 shown in FIG. 3 is made up by sticking winding plates 12*a*, 12*b* formed by stamping a sheet of metal plate into a spiral pattern on both sides of an insulating board 11 made of insulating material and having a U-shaped outline, and then connecting the end 12*c* of the winding plate 12*a* with the end 12*d* of the winding plate 12*b* through the insulating plate 11 by welding or the like. The configuration of the tabular primary winding 1 eliminates the work of winding a conductor wire, giving in an improved productivity thereof.

Figure 4:
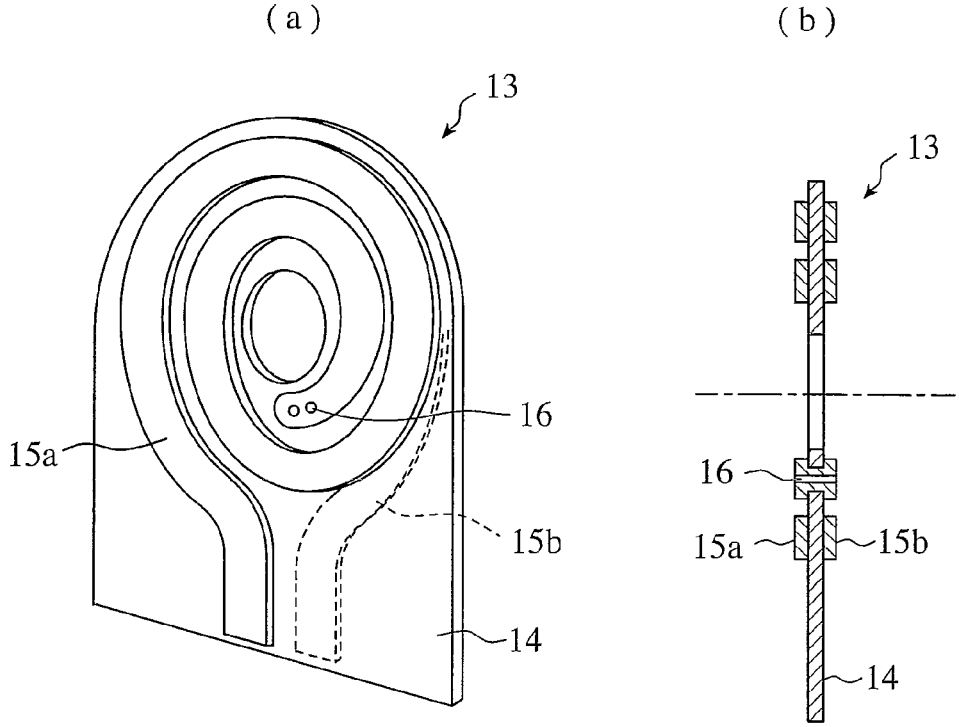
FIG. 4 (*a*) is a perspective view of a primary winding having a flat-plate shape according to another example, and FIG. 4 (*b*) is a cross-sectional view thereof.

FIG. 4 (*a*) and FIG. 4 (*b*) show another example of the tabular primary winding 13. The primary winding 13 is made up by forming spiral copper foil patterns 15*a*, 15*b* on both sides of a printed board 14, respectively, and then connecting the copper foil patterns 15*a*, 15*b* with each other through a through hole 16. Such a configuration of the primary winding 13 also eliminates the work of winding a conductor wire, giving an improved productivity thereof.

Figure 5:
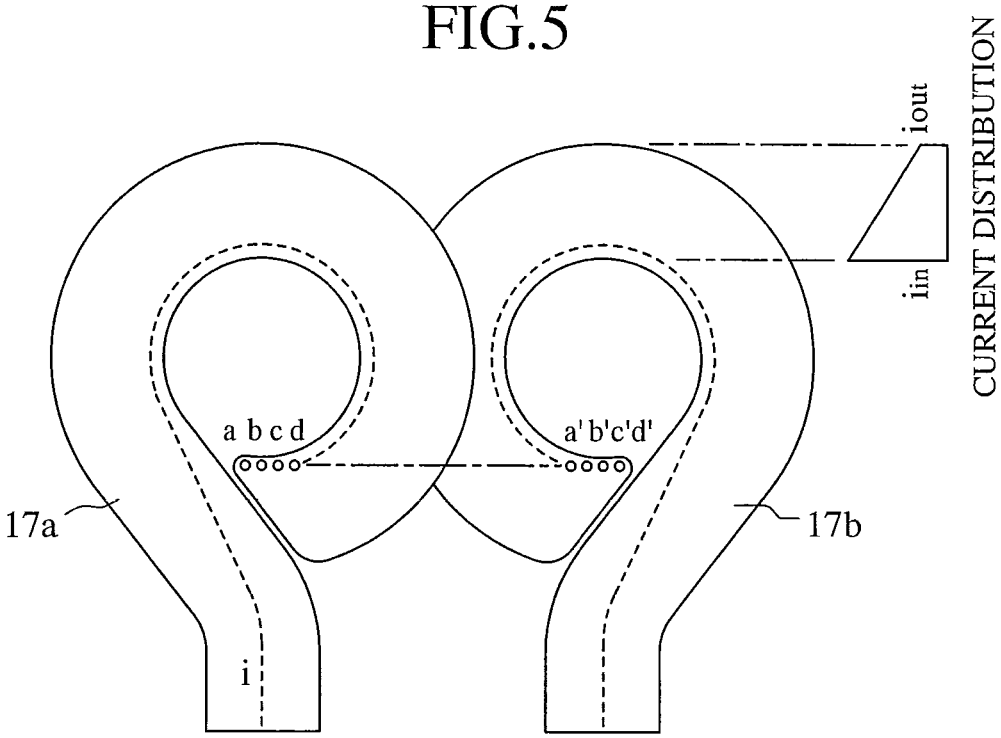
FIG. 5 is a structural explanatory view of the winding portion of a primary winding having a flat-plate shape.
Figure 6:
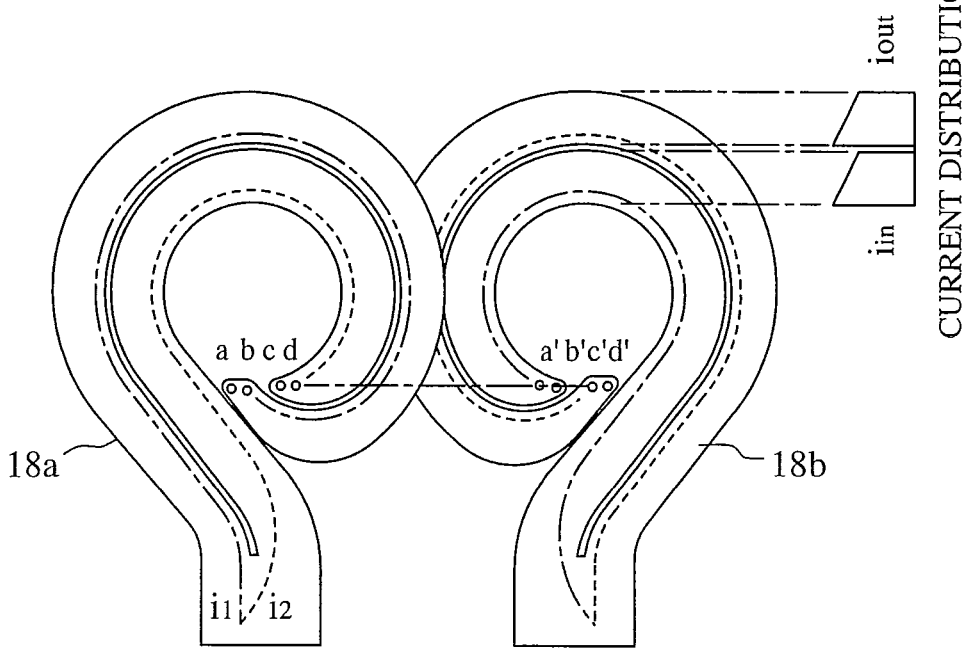
FIG. 6 is a structural explanatory view of another example of the winding portion of a primary winding having a flat-plate shape.

FIG. 5 and FIG. 6 illustrate examples of spiral patterns. The wide spiral patterns 17*a*, 17*b* shown in FIG. 5 each have a higher current density in the inner portion of the spiral, and have a lower one in the outer portion thereof. The portions indicated by a, b, c, and d of the pattern 17*a* in FIG. 5 are connected with the portions indicated by a', b', c', and d' of the pattern 17*b*, respectively. The spiral patterns 18*a*, 18*b* shown in FIG. 6 are respectively formed by dividing each of the patterns 17*a*, 17*b* shown in FIG. 5 into two parts by slits provided therealong. The path length and the cross-sectional area of the divided patterns are substantially equal to those of the patterns shown in FIG. 5. The portions indicated by a, b, c, and d of the pattern 18*a* in FIG. 6 are connected with the portions indicated by a', b', c', and d' of the pattern 18*b*, respectively. In the figure, "iin" represents the current in the inner portion of the pattern and "iout" represents the current in the outer portion thereof. As shown in the example, dividing the cross section of the pattern into several sections can make more uniform the current flowing through the primary winding, thus enabling the magnetic field generated by the primary winding to be parallel and uniform with respect to the primary winding. Therefore, this allows the magnetic flux generated by the primary winding to easily make an interlinkage with the secondary winding, and enhances the characteristics of the transformer.

Note that for the tabular primary winding, when the following configuration is employed: a plurality of electrical wires each having a round cross-section are wound in parallel in a spiral sheet shape, it can also bring about a similar effect.

Figure 7:
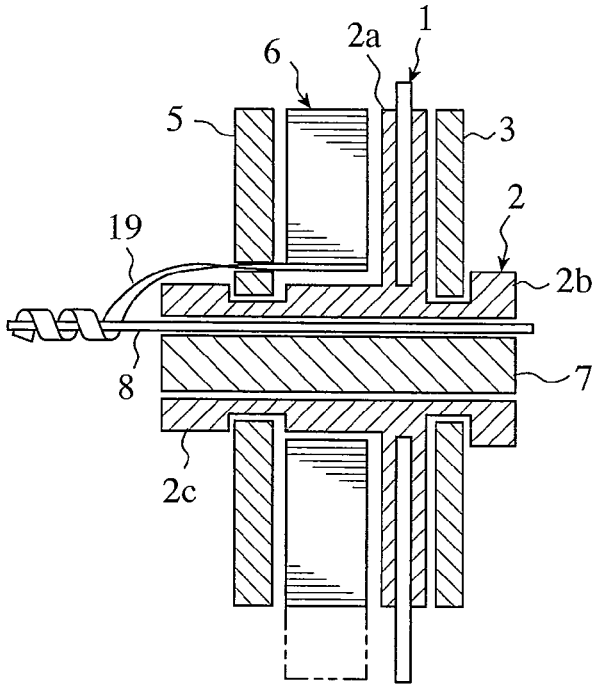
FIG. 7 is a longitudinal cross-sectional view of a sheet type transformer of the first embodiment.
Figure 8:
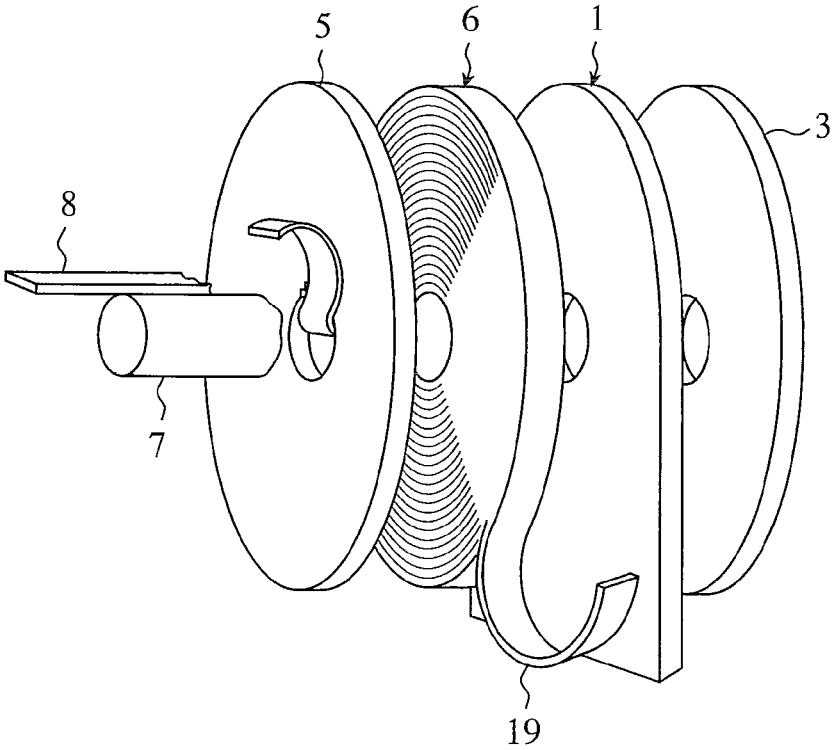
FIG. 8 is an exploded perspective view of the first embodiment.

FIG. 7 and FIG. 8 show a sheet type transformer where rectangular wire 19 of rectangular cross-section is employed for a conductor wire forming the secondary winding 6 as a modification of the sheet type transformer shown in FIG. 1. To be more specific, the rectangular wire 19 is wound within the space 4 to form the secondary winding 6. The simply scrolled rectangular wire 19 can be easily wound with a high space factor of winding to provide the secondary winding 6 and a maximum cross-sectional area.

According to the sheet type transformer of the first embodiment, the transformer is formed by forming the primary winding 1 in a tabular form, while winding the secondary winding 6 by scrolling a rectangular wire into multi layers in the radial direction corresponding to the radial size of the primary winding 1, and thus the distance between the winding starting point and the winding ending point can be increased. Further, the end on the radially central side of the secondary winding 6 is drawn out directly outside the bobbin 2 and the cores 5, 7. In other words, the lead wire of the secondary winding 6 energized with a high voltage is never returned along the secondary winding 6, and thus a large distance (insulation distance) can be put between the winding starting point and the winding ending point of the winding wire material of the secondary winding 6, enabling the acquisition of sufficient withstand voltage properties against the high voltage generated by the secondary winding 6. Moreover, the high voltage portions of the transformer are concentrated in the central portion thereof, and the high voltage portion of the secondary winding 6 is located in the deepest portion (the radially central portion of the winding) of the bobbin 2 for insulating the secondary winding from the primary winding 1, and thus the insulating barrier (the thickness of the bobbin 2) and the insulating distance (the depth of the bobbin 2) between the high voltage portion of the secondary winding 6 and the primary winding 1 energized with a low voltage can be secured. Therefore, the development of a sheet type transformer applicable for high-voltage transformers, having sufficient insulating properties can be achieved by a simple structure.

Further, according to the sheet type transformer of the first embodiment, the terminal 8 is provided within a narrow space subjected to a high voltage, and thus the insulating properties for a high voltage can be secured by the insulating member that is separated from the members of low voltage and is located within the narrow range. Moreover, if the central core 7 insulated from other members contacts a high-voltage output potential, no current flows to the other members. Thus, the terminal 8 and the central core 7 do not have to be insulated from each other. Therefore, the central core 7 and the terminal 8 can be disposed adjacent each other without an insulating member in between and the clearance therebetween can be eliminated. Thus, both of them can be disposed in a small space. In particular, when magnetic material having large electric resistance such as ferrite is used for the central core 7, even if the terminals 8 at both ends of the secondary winding 6 are disposed adjacent to the central core 7, the leakage of current is small, and there arises no electric problem.

In the above, the sheet type transformer is discussed by taking a rod-shaped core as an example of the central core 7; however, the transformer can be constructed by use of a pipe-shaped core hollow in the central portion or a core divided into two parts, and further, the transformer also can be built by use of a terminal located within a pipe or sandwiched between the portions of a divided core.

According to the sheet type transformer of the first embodiment, plates 12*a*, 12*b* the outer shapes of which are formed by press working, shown in FIG. 3, are sticked on both sides of a board to form the primary winding 1. Thus, the winding work for the primary winding becomes unnecessary and the manufacturing time of the sheet type transformer can be greatly shortened. Further, when the winding member formed of a printed circuit board shown in FIG. 4 is employed as the primary winding 1, the necessity of the winding work for the primary winding is similarly eliminated. Thus, the fabrication time of the sheet type transformer can be greatly reduced.

According to the sheet type transformer of the first embodiment, the primary winding 1 is embedded in and molded integral with the bobbin 2 by means of injection molding, and thus the bobbin 2 is primarily provided with the primary winding 1. Therefore, there is no necessity of winding the primary winding in the process after fabricating the bobbin, enabling the productivity to be enhanced.

The sheet type transformer of the first embodiment is applied to discharge lamp lighting apparatuses, for example; however, it is not so limited thereto, and the sheet type transformer is suitable for use in transformers where the voltage applied to the winding or generated by the winding is high, and the insulating distances between the lead wires and the terminals should be suitably secured. For example, even in a transformer for a DC/DC converter where the primary winding is of high voltage (e.g., 100 V) and the secondary windings is of low voltage (e.g., 5 V), when it is difficult to separate the terminal of 100 V from other terminals because the transformer is miniaturized, the arrangement of the transformer according to the present invention where the members on the high voltage (100 V) side are disposed in the central portion thereof can advantageously provide sufficient withstand voltage properties.

Second Embodiment

Figure 9:
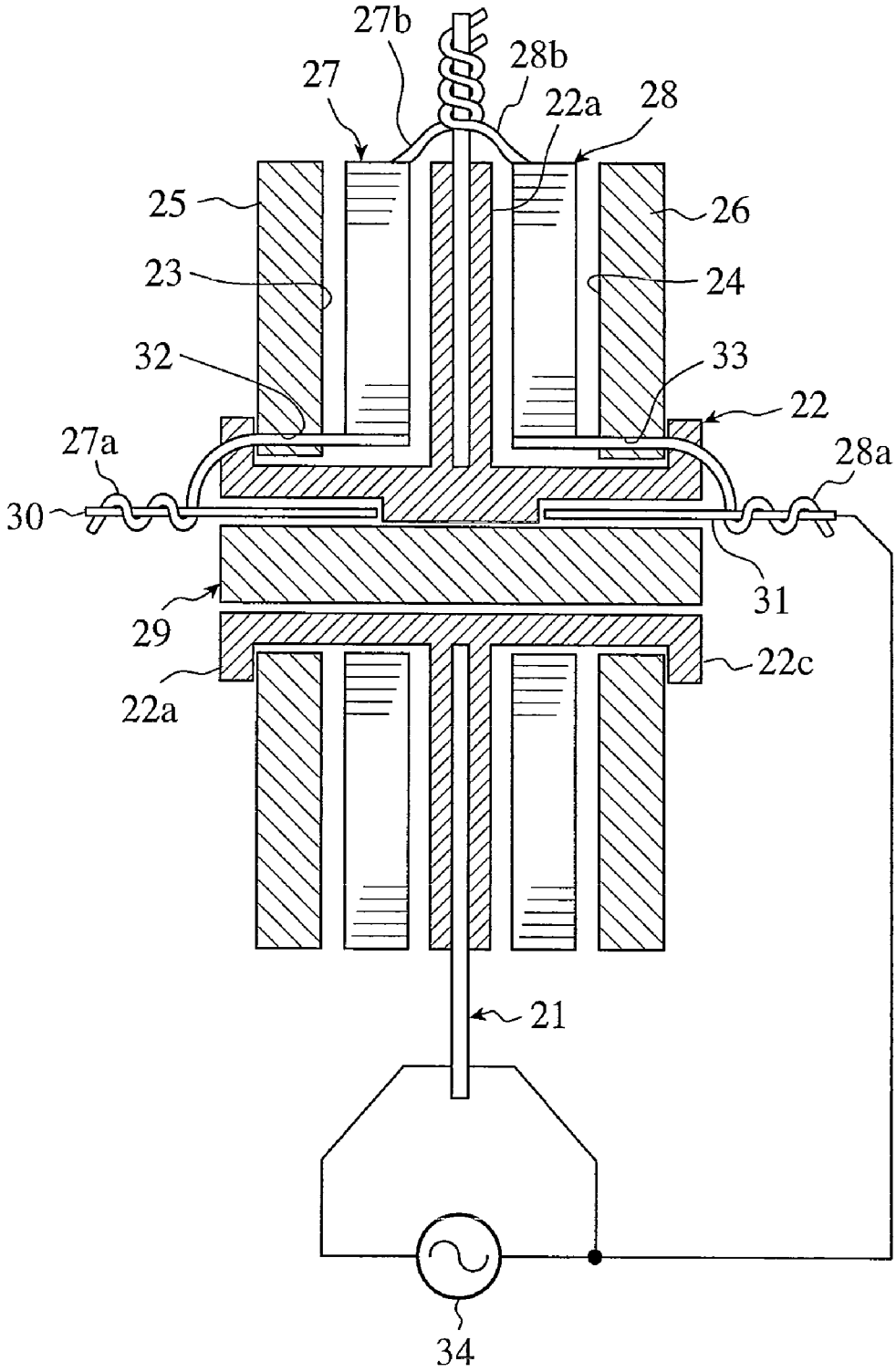
FIG. 9 is an exploded perspective view of a sheet type transformer of the second embodiment.

FIG. 9 shows a cross-sectional view of a sheet type transformer of the second embodiment. The sheet type transformer is formed by assigning respective secondary windings on both sides of a primary winding.

The central portion of a tabular primary winding 21 is embedded in and held by the outer periphery of the mid-portion of a bobbin 22 cylindrical in its central portion. The tabular primary winding 21 is held in conditions where the winding is embedded in the bobbin 22 by injection molding or the like by which the tabular primary winding 21 is set within a metal mold of injection molding and then a resin is injected into the metal mold. A first plate core 25 and a second plate core 26 are provided centering the embedded portion 22*a* of the primary winding 21, opposed to the embedded portion 22*a* and spaced therefrom by spaces 23, 24 on both sides in an axial direction of the bobbin 22, respectively. Those plate cores 25, 26 are together integrally held by the bobbin 22 when the bobbin 22 is molded while embedding the primary winding 1 therein to form part of the bobbin 22. In order to position the plate cores 25, 26 on the bobbin 22, flanges 22*b*, 22*c* are formed at both ends of the bobbin 22.

Secondary windings 27, 28 are formed by winding conductor wire around the central stem of the bobbin 22 within the spaces (spools) 23, 24 between the primary winding embedded portion 22*a* of the bobbin 22 and the first and second plate cores 25 and 26, respectively. A conductor wire of round cross-section or rectangular cross-section is employed for the conductor wire of the secondary windings 27, 28. Ends 27*a*, 28*a* on the central side in the radial direction (on the central stem side of the bobbin 22) of the secondary windings 27, 28 that are the ends on the high voltage side of the secondary windings are not drawn out outwardly in the radial direction of the secondary windings 27, 28, and the ends are drawn out outside the plate cores 25, 26, respectively. Ends 27*b*, 28*b* on the low voltage sides of the secondary windings 27, 28 that are the other ends thereof are radially outwardly drawn out.

A cylindrical central core 29 is inserted in the inner portion of the bobbin 22. Plate-shaped terminals 30, 31 are inserted between the central core 29 made from magnetic material of high electric resistance and the bobbin 22 from both ends of the bobbin 22. The ends 27*a*, 28*a* on the high voltage sides of the secondary windings 27, 28 drawn out outside the plate cores 25, 26 are connected to the terminals 30, 31. The plate cores 25, 26 are provided with lead holes 32, 33 for drawing out the ends 27*a*, 28*a* of the secondary windings 27, 28.

The tabular primary winding 21 is formed as shown in FIG. 3 and FIG. 4, and the edge of the substrate thereof is radially projected to form an intermediate terminal. With respect to the intermediate terminal, the ends 27*b*, 28*b* drawn out in a radial direction of the secondary windings 27, 28 are entwined, thereby connecting the secondary windings 27, 28 to each other. That is, the number of coil turns of the secondary winding can be dispersed, the size in a diametrical direction of the secondary winding can be reduced, the distance between the primary winding and the secondary winding can be reduced, high coupling therebetween can be provided, and the characteristics of the transformer can be enhanced.

In addition, FIG. 9 shows a schematic connection circuit in addition to the structures thereof. A power source 34 is connected with the primary winding 21. The conductor wire connected with the one side of the primary winding 21 is connected to the terminal 31 on the high voltage side thereof.

Figure 10:
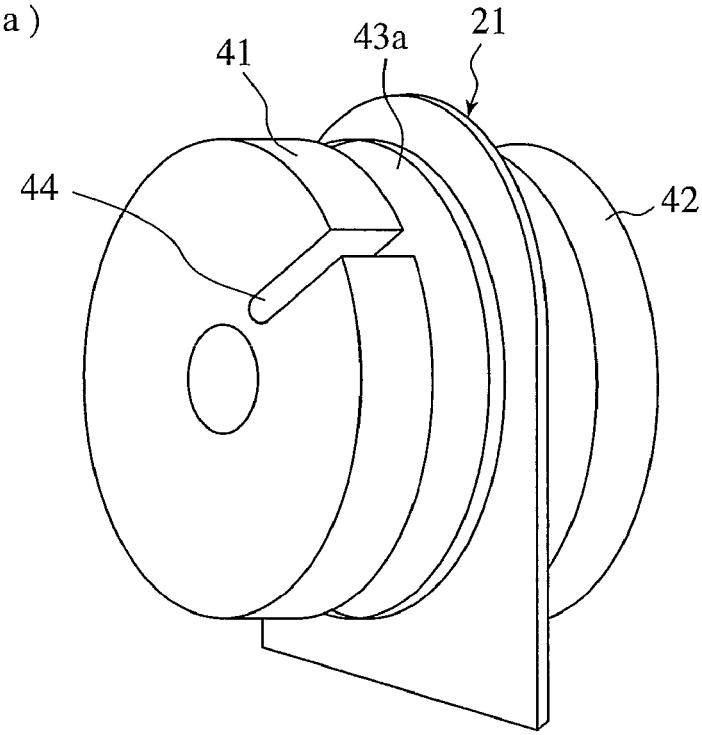
FIG. 10 (*a*) is a perspective view of a primary winding having a flat-plate shape of another example, and FIG. 10 (*b*) is a cross-sectional view thereof.
Figure 10:
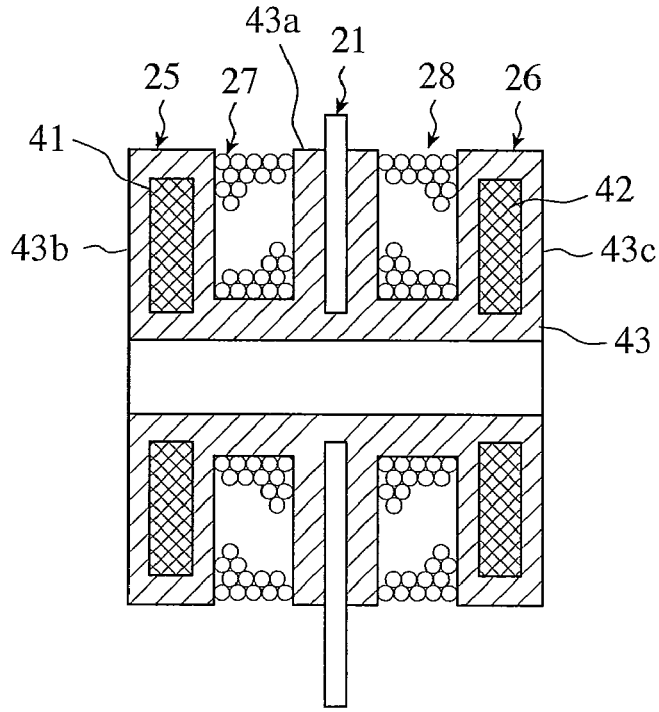

In the sheet type transformer shown in FIG. 9, highly insulative material is used for the plate cores 25, 26 and the plate cores 25, 26 are not covered. Further, FIG. 10 (*a*) and FIG. 10 (*b*) show an example where the plate cores 41, 42 opposed to the respective faces of the primary winding 21 are completely embedded within the bobbin 43. In order to mold the bobbin 43, the tabular primary winding 21 and the plate cores 41, 42 are positioned within a metal mold, and then insulating resin is injected into the metal mold. The tabular primary winding 21 is formed as a primary-winding embedded portion 43*a*, and the plate cores 41, 42 are formed as plate-core embedded portions 43*b*, 43*c*, respectively. The spaces between the primary-winding embedded portion 43*a* and each of the plate-core embedded portions 43*b*, 43*c* each form a spool, and conductor wire is wound about the spool to form the secondary windings 27, 28. In this context, it is also possible to form the central core integral with the bobbin 43 by molding the central core (not shown. See the central core 29 shown in FIG. 9) with resin into which magnetic powder is incorporated. In that case, it is preferable to increase the cross-sectional area of the central core to maintain the permeability thereof. Further, in the example, the plate-core embedded portion 43*b* is provided with a groove 44 pointing outwardly in the radial direction for drawing out the end of the winding, and this will be discussed later.

According to the sheet type transformer of the second embodiment, the secondary winding is divided, and thus the size thereof can be reduced also in the radial direction in addition to the advantageous effect of the sheet type transformer of the first embodiment. The distance between the primary winding 21 and the secondary windings 27, 28 can be reduced, high coupling therebetween can be obtained, and the characteristics of the transformer can be improved.

Third Embodiment

Figure 11:
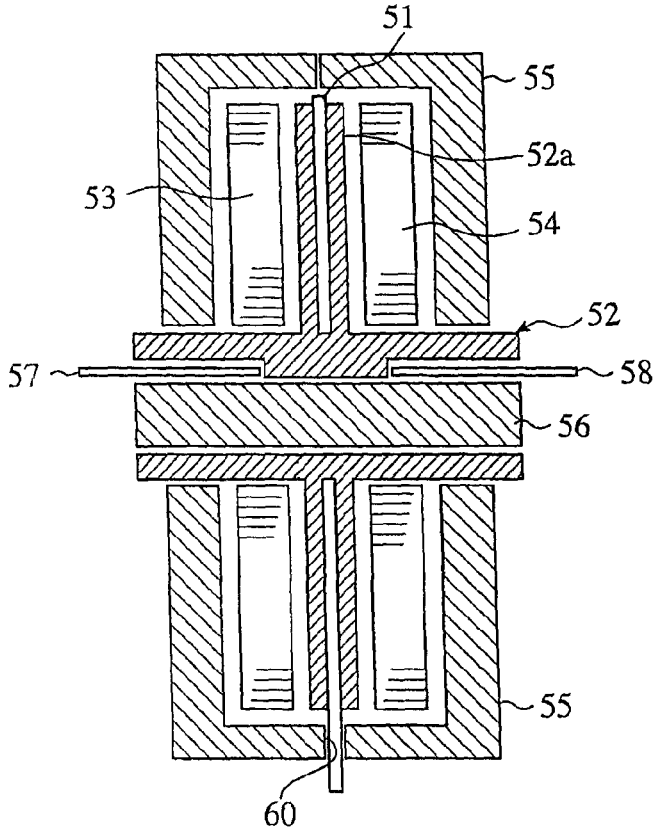
FIG. 11 is a longitudinal sectional view of a sheet type transformer of the third embodiment.

FIG. 11 shows a cross-sectional view of a sheet type transformer of the third embodiment. The sheet type transformer is arranged so as to reduce the leakage of the magnetic flux generated therein as much as possible.

A gently angular waveform ascending with some inclination is required of the high-voltage pulse needed in lighting a discharge lamp (HID bulb). For this reason, a plate-shaped magnetic material forming an open magnetic circuit can be used as an igniter transformer of a discharge lamp apparatus. However, in transformers used for a DC/DC or DC/AC converter, it is preferable to cause all the magnetic flux generated by a primary winding to make an interlinkage with a secondary winding, it is required to enhance the coupling therebetween, and in order to strengthen the coupling, it is needed to place the magnetic circuit in a closed magnetic circuit condition. For this reason, in the third embodiment, it is arranged that a wall made of magnetic body covering all or substantially all of the peripheral portions of the secondary winding and part of the primary winding be provided.

In the sheet type transformer, the central portion of a tabular primary winding 51 is embedded in and held by the outer peripheral portion of a bobbin 52 cylindrical in the mid-portion. The tabular primary winding 51 is held in condition where the winding is embedded in the bobbin 52 by injection molding or the equivalent by which the tabular primary winding 51 is set in a metal mold of injection molding and then resin is injected into the metal mold. The secondary windings 53, 54 are formed by winding conductor wire about the stem portion of the bobbin 52 on both sides in the axial direction of the embedded portion 52*a* of the primary winding 51. Conductor wire of round cross-section or rectangular cross-section is used as the conductor wire of the secondary windings 53, 54.

Figure 12:
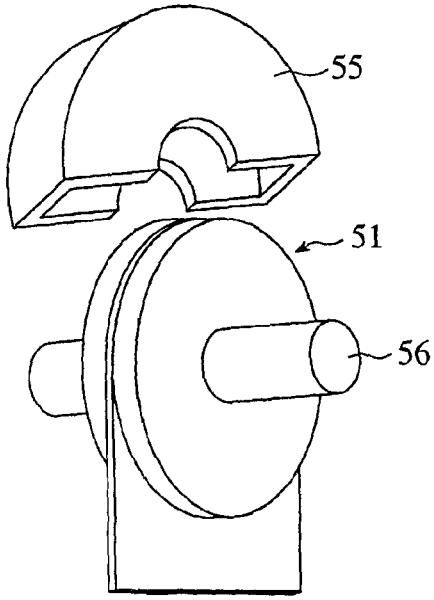
FIG. 12 is an exploded perspective view of the sheet type transformer of the third embodiment.

The primary winding 51 and the secondary windings 53, 54 are separated from each other in the axial direction as shown in FIG. 11; however, they are covered with a core 55 that is of cup shape and vertically divided as shown in FIG. 12. Two cup-shaped cores 55 are brought together and coupled with the bobbin 52. This is because the magnetic circuit is closed to prevent the magnetism from being leaked and thereby the inductance is increased. The central portion of the bobbin 52 is provided with a central core 56. Terminals 57, 58 are provided between the bobbin 52 and the central core 56.

In the above, the sheet type transformer is discussed by taking a rod-shaped core as an example of the central core 56; however, it may be arranged that holes be provide through the central portions of the both ends of the core, and the terminals 57, 58 be inserted therethrough and fixed therein.

The ends on the axial inside of the secondary windings 53, 54 are drawn out outwardly from the cup-shaped core 55 through the holes (not shown) provided through the cup-shaped core 55, and are connected with the terminals 57, 58, respectively. The ends drawn out radially outside the secondary windings 53, 54 are not drawn out outwardly from the cup-shaped core 55, and they are connected with each other therewithin. The core 55 located below in the state shown in FIG. 11 is provided with a hole or slit 60 such that part of the tabular winding 51 projects, and a power source is connected to the portion of the tabular winding 51 projecting from the core 55 (see FIG. 9).

According to the sheet type transformer of the third embodiment, the circumferences of the primary winding 51 and the secondary windings 53, 54 are covered with the cup-shaped core 55, in addition to the advantageous effect by the first embodiment, and thus the almost all the magnetic flux generated by the primary winding 51 can be led to an interlinkage with the secondary windings 53, 54. Therefore, the leakage of the magnetic flux is reduced, and the characteristics of the transformer are improved.

Fourth Embodiment

Figure 13:
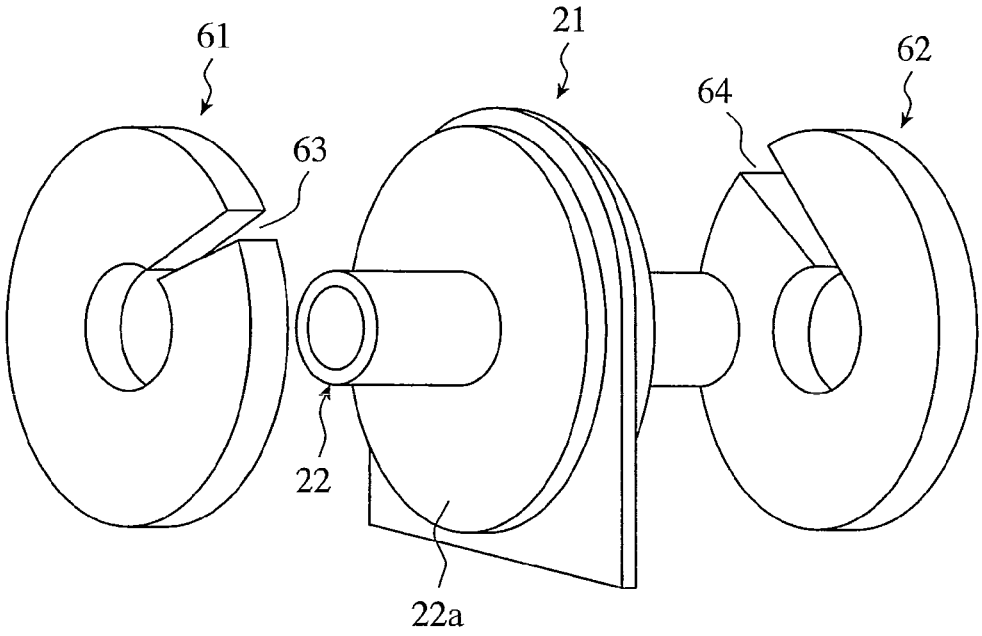
FIG. 13 is an exploded perspective view of a sheet type transformer of the fourth embodiment.

FIG. 13 shows an exploded perspective external view of a sheet type transformer of the fourth embodiment. The sheet type transformer is a transformer improved in the form of the plate core of the sheet type transformer shown in FIG. 9.

In the secondary winding, conductor wires are scrolled in one or more layers, and thus a distance can be maintained between the lower and the upper layers in the winding. Therefore, the lower layers are isolated from the upper layers having a large potential difference and the lowest layer is directly drawn out in an axial direction thereof to thus ensure a withstand voltage. In the above-described embodiments, it is arranged that a hole is bored through the central side of the plate core and the conductor wire is drawn out therethrough; however, in the fourth embodiment, as shown in FIG. 13, plate cores 61, 62 provided on both sides of the embedded portion 22*a* of the primary winding 21 interposed therebetween are provided with slits 63, 64 each extending radially outwardly from the central hole thereof through the peripheral portion. When the secondary windings are formed, first, a conductor wire is fell down to the central portion of the bobbin 22 through the slit 63, 64, and then, the conductor wire is wound about the bobbin 22 to thereby form the secondary winding. That is, simply falling down the conductor wire through the slit 63, 64 can draw out the end of the winding of a high voltage outwardly from the plate core, and thus the secondary winding can be easily manufactured.

Figure 14:
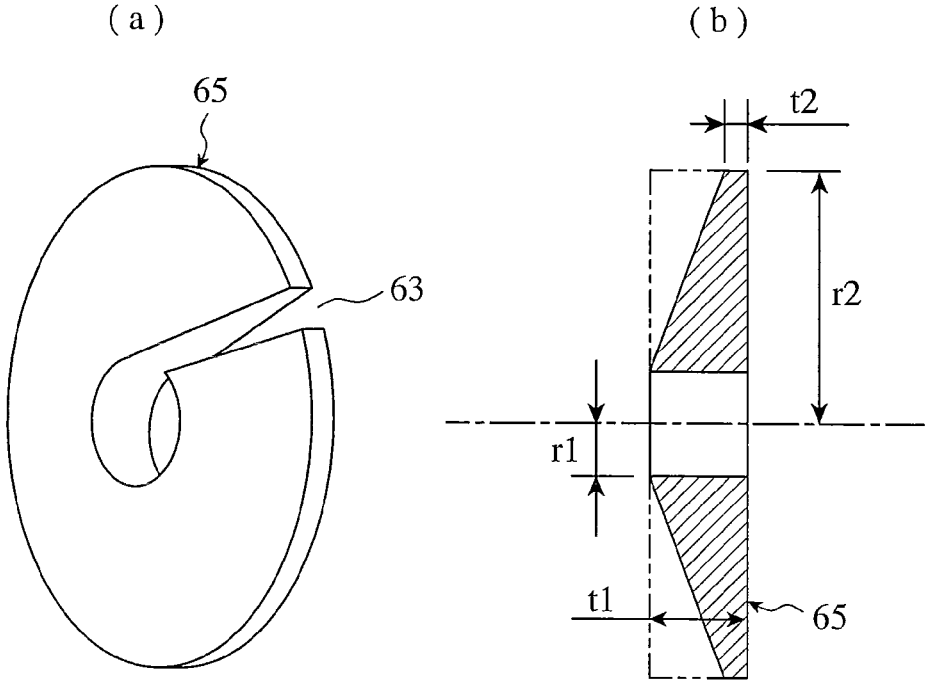
FIG. 14 (*a*) is a perspective view of a plate core in the fourth embodiment, and FIG. 14 (*b*) is the cross-sectional view thereof.

FIG. 14 (*a*) and FIG. 14 (*b*) show a plate core 65 that is a modification of the plate core 61 (the plate core 62 is also similar thereto). The plate core 65 is thickened in the central portion and thinned in the peripheral portion. The magnetic flux generated by the primary winding is uniform in amount in any cross section of the magnetic circuit, and thus equalizing the magnetic circuits of the portions in cross-section can make uniform the magnetic flux density in the magnetic member. Therefore, in order for each of the portions of the magnetic member to have an equal cross-sectional area with respect to the direction of the magnetic flux, it can be arranged that the thickness of the magnetic circuit opposed to the portion where the circumferential length of the winding in the vicinity of the central core is short be increased and the thickness of the magnetic circuit opposed to the portion where the circumferential length in the peripheral portion of the winding is long be reduced. Referring to FIG. 14 (*a*) and FIG. 14 (*b*), the magnetic cross-sectional area of the inner peripheral portion of the core 65 is $2\pi \times r1 \times t1$, where the radius is r1 and the thickness is t1, and the magnetic cross-sectional area of the outer peripheral portion of the core is $2\pi \times r2 \times t2$, where the radius is r2 and the thickness is t2. Thus, even if the thickness t2 of the core in the outer peripheral portion made thinner than the thickness t1 thereof in the central portion, the thinned core does not deteriorate the magnetic flux. As described above, the reduction of the thickness of the portion of the magnetic member opposed to the outer peripheral portion of the winding reduces the usage of the resin into which expensive magnetic material powder is incorporated, and thus transformers can be produced at lower cost.

According to the fourth embodiment, the plate core is provided with the slit used for drawing out the conductor wire, and thus the end of the conductor wire can be easily drawn out from the central side of the bobbin before winding the secondary winding in addition to the effect of the first embodiment. Winding operation becomes easy.

Fifth Embodiment

Figure 15:
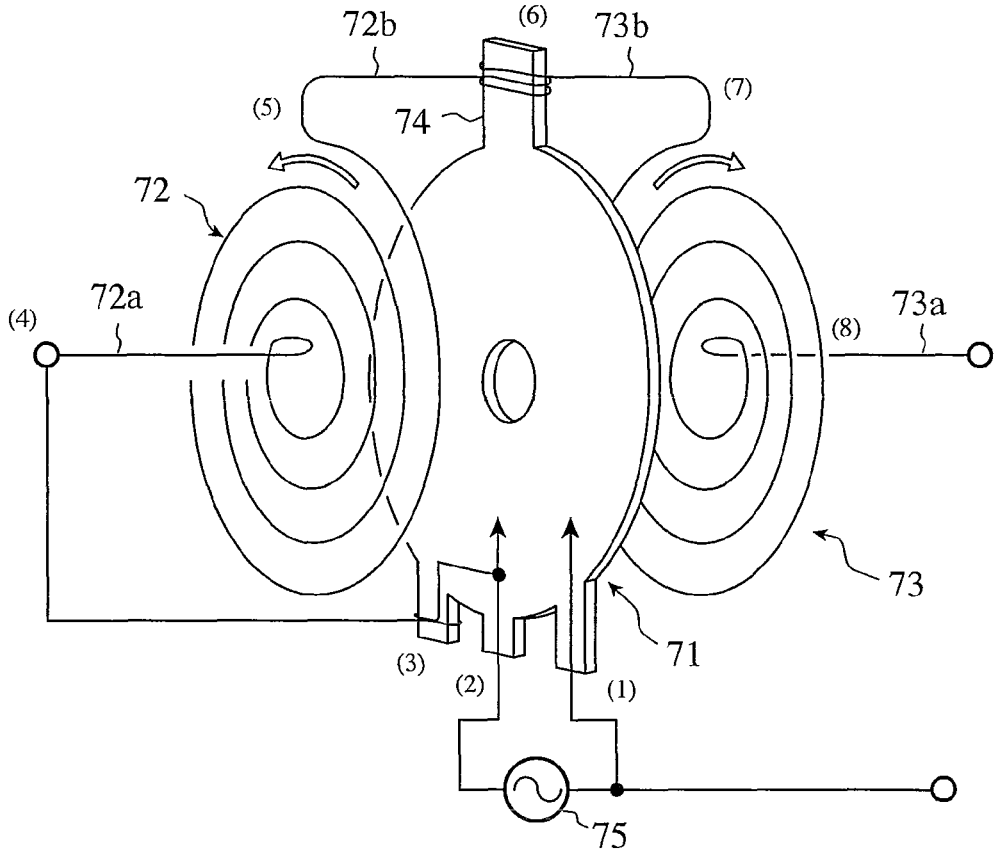
FIG. 15 is a schematic configuration diagram of a sheet type transformer of the fifth embodiment.
Figure 16:
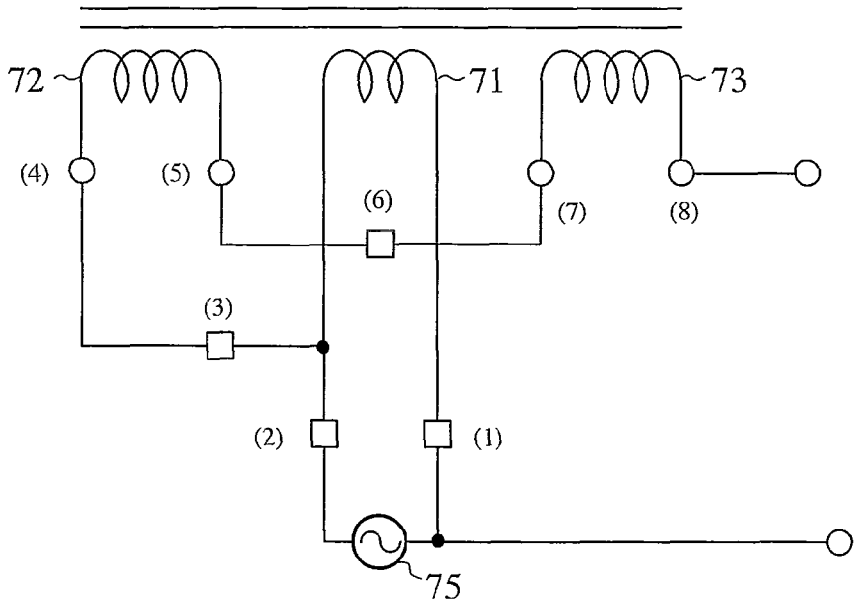
FIG. 16 is a circuit diagram of the fifth embodiment.

FIG. 15 shows the schematic configuration of a sheet type transformer of the fifth embodiment, and FIG. 16 shows the circuit thereof. The sheet type transformer employs an improved winding method of the secondary winding.

In the sheet type transformer formed by dividing the secondary winding between both sides of the primary winding as shown in FIG. 9 and other figures, the direction of winding the secondary winding is reversed between a left side secondary winding 72 and a right side one 73 with a primary winding 71 as the boundary (arrows in the figure show the respective winding directions); the low voltage end 72*a* of the low voltage side winding 72 of the secondary winding and the high voltage end 73*a* of the high voltage side winding 73 thereof are disposed on the respective central sides of the secondary winding; and the high voltage end 72*b* of the low voltage side winding 72 of the secondary winding and the low voltage end 73*b* of the high voltage side winding 73 thereof are connected at the primary winding disposing portion. The edge portion of the substrate of the primary winding 71 is provided with a connection section (entwining section) 74 radially outwardly projecting for connecting the high voltage end 72*b* of the low voltage side winding 72 and the low voltage end 73*b* of the high voltage side winding 73 to each other. FIG. 15 and FIG. 16 show the connection condition of a power source 75 and the windings 71, 72, and 73, and reference numerals (1)-(8) denote the connection points thereof.

The central side ends of the bobbins of the secondary windings 72, 73, that is, the low voltage end 72*a* of the low voltage side winding 72 of the secondary winding and the high voltage end 73*a* of the high voltage side winding 73 thereof are drawn out outside in the axial direction of the bobbin by way of the holes or slits provided through the core plate on the bobbin as in the above-described cases.

In a conventional one-way winding method, it is required that the winding of a wire material be started at the deepest portion of a bobbin, the wire material be wound up to the radially outermost portion, then the wire material be led into the deepest portion of a bobbin adjacent thereto, and further the material be wound toward the periphery again. In order to lead the wire material into the deepest portion thereof from the radially outermost periphery, it is necessary that a partition for separating the adjoining bobbins be provided with a clearance for securing insulation between the wire material and the windings wound about the bobbins, and further the partition be provided with a groove or space for leading the wire material into the deepest portion thereof from the radially outermost periphery. Thus, it is impossible to reduce the thickness of the partition positioned between the adjoining bobbins. The thickness of the partition increases the length of the bobbin, and thus the thickness thereof is a problem in reducing the axial length of the bobbin.

As in the fifth embodiment, when the secondary winding is divided into the low-voltage side secondary winding 72 and the high-voltage side secondary winding 73 with the primary winding 71 as a boundary; the direction of winding the secondary winding is reversed between the low-voltage side secondary winding and the high-voltage side one; and the low voltage side end 72*a* of the low-voltage side secondary winding 72 and the high voltage side end 73*a* of the high-voltage side secondary winding 73 are disposed at the central portion between the secondary windings 72, 73, the ends 72*b*, 73*b* of the radially outermost peripheries of the low voltage side secondary winding 72 and the high voltage side secondary winding 73 become of the same potential. When the ends 72*b*, 73*b* of the outermost peripheral portions of the low-voltage side secondary winding and the high-voltage side second winding are connected to each other at the position of the primary winding 71 located between the secondary windings 72, 73, it is possible to connect them in the shortest distance without routing the secondary windings 72, 73 from the outermost periphery to the deepest portion, dispose the respective secondary windings (portions) 72, 73 into which the secondary winding is divided and the primary winding 71 disposed at the center therebetween in close relation to each other, and thereby achieve the production of a bobbin having an axially shortened length.

In order to wind the secondary winding in the winding direction reversed at a midpoint, it is required to wind the secondary winding in two parts of the low-voltage secondary winding 72 and the high-voltage secondary winding 73. At that time, the second time wound secondary winding 73 (or 72) should be wound such that the terminal portion of the first wound secondary winding 72 (or 73) is not unwound. Therefore, the printed circuit board constituting the primary winding 71 is caused to radially outwardly partially project to form the connection section 74 and the terminal portion of the wound secondary winding is entwined about the section. The winding end 72*b* is entwined about the section, which prevents the wound secondary winding 72 (or 73) from being unwound or loosed. Further, on the connection section 74 (the node (6)), the ends 72*b*, 73*b* of the secondary windings 72, 73 are connected to each other, and thus the connection between the ends 72*b* and 73*b* becomes easy.

In addition, when soldering is used for the method of electrically connecting the secondary windings 72, 73 formed in two parts, the connection section 74 has to withstand the melting temperature of solder. At that time, providing a metallic terminal on the connection section 74 is a possible method. When the primary winding 71 is fabricated by use of a printed circuit board, forming a projection-shaped connection section clad with a copper foil at one place on the member for the primary winding provides a connection section having sufficient heat resistance against the heat transmitted in soldering, and thus positive electrical connection therebetween can be provided by soldering.

According to the sheet type transformer of the fifth embodiment, a sheet type transformer short in the axial direction can be provided as described hereinabove. Further, the connection section 74 for entwining the winding is provided thereon, and thus the connection between the secondary windings 72, 73 becomes easy, enabling the winding work to be simplified.

Sixth Embodiment

Figure 17:
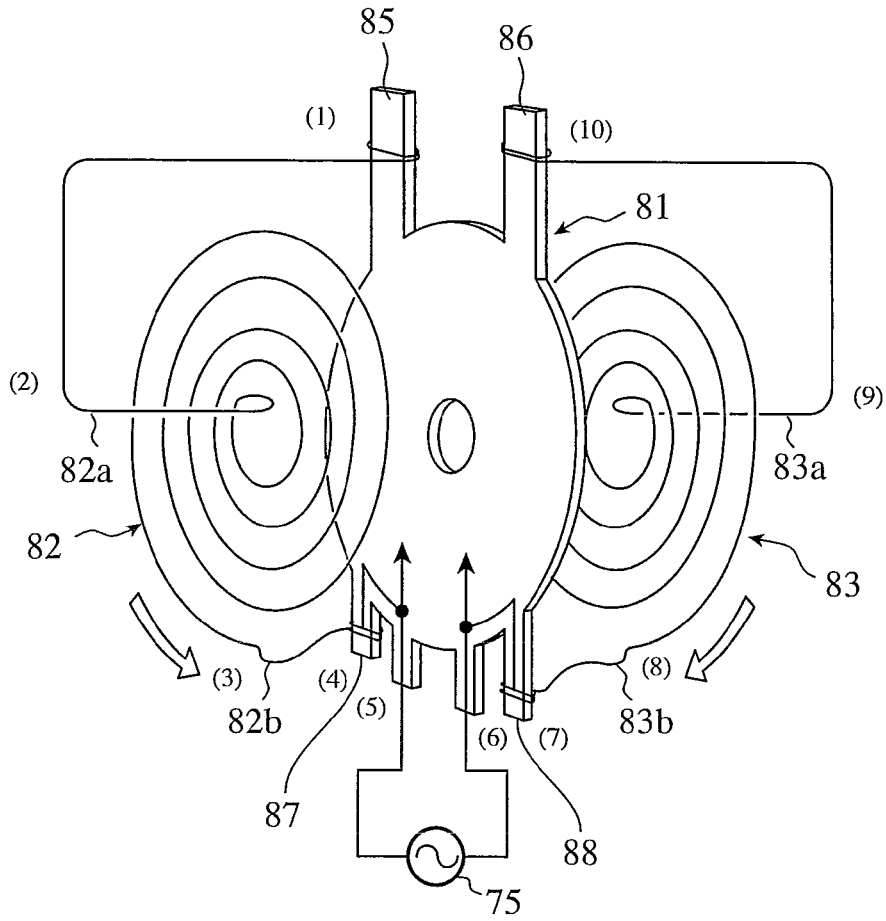
FIG. 17 is a schematic configuration diagram of a sheet type transformer of the sixth embodiment.
Figure 18:
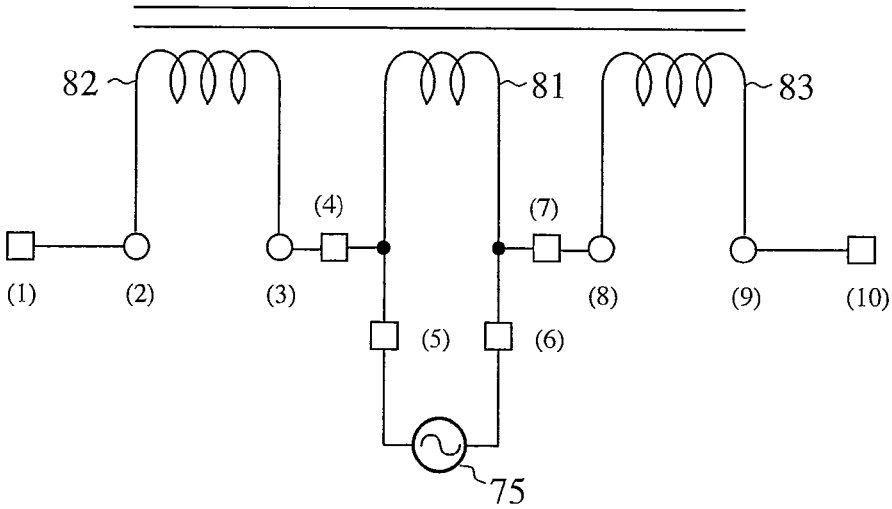
FIG. 18 is a circuit diagram of the sixth embodiment.

FIG. 17 shows a schematic configuration of a sheet type transformer of the sixth embodiment, and FIG. 18 shows the circuit thereof. The sheet type transformer employs the improved winding method of the secondary winding.

Secondary windings 82, 83 are wound and formed in two parts between both sides of a primary winding 81, respectively (the arrows of the figure show the directions where the windings are wound). The winding end potions 82*a*, 83*a* of the divided secondary windings 82, 83 that are drawn out to the respective central stem sides serve the function of the respective output terminals on the high voltage sides the polarities of which are different from each other, and the winding ends 82*b*, 83*b* thereof drawn out from the respective outermost peripheral sides of the secondary windings 82, 83 serve the function of the input terminals on the low voltage sides, respectively. FIG. 17 and FIG. 18 show the conditions where the power source 75 and the windings 81, 82, and 83 are connected, and the reference numerals (1)-(10) denote the connecting points thereof.

The central side ends with respect to the bobbin of the secondary windings 82, 83, namely the high voltage end 82*a* of the low voltage side winding 82 of the secondary winding and the high voltage end 83*a* of the high voltage side winding 83 thereof, are drawn out outside in the axial direction of the bobbin through the holes or slits provided through the core plate on the bobbin as with the above-described cases.

If the secondary winding is divided into the windings 82, 83 outputting high voltages the polarities of which are different from each other with the primary winding 81 as a boundary, and the respective high voltage ends 82*a*, 83*a* are disposed at the central portions of the secondary windings 82, 83, a high-voltage generating transformer which simultaneously outputs the plus side output and the minus side output the polarities of which are reversed to each other can be constructed. For example, when the transformer is used for a transformer for an igniter starting lighting a discharge lamp (HID bulb), the output of the discharge lamp apparatus is connected with the low voltage input side of both the secondary windings on the outermost peripheral side, and the ends 82*a*, 83*a* of both the secondary windings which an output high voltage on the central side are connected with the respective terminals of the discharge lamp (connection points (1), (10) in the figures). Thereby, while the potential difference between both the high voltage ends is high and high voltage is sufficiently applied to the discharge lamp, the voltage applied to each of the terminals of the discharge lamp is ½ voltage the polarity of which is different from that of the other. Thus, the transfer serves the function of a transfer for an igniter which is preferable in insulation properties and safety.

A member constituting the primary winding 81, for example, a printed circuit board 81*a*, is provided with connection sections (entwining sections) 85, 86 for output by projecting the printed circuit board in a radial direction thereof; the high voltage end 82*a* of the secondary winding 82 on the low voltage side (node (1)) is connected to the connection section 85; and the high voltage end 83*a* of the secondary winding 83 on the high voltage side (node (10)) is connected to the connection section 86. Further, the member constituting the primary winding 81 is provided with connection sections 87, 88 for connecting the low voltage sides of the secondary windings 82, 83 to a path leading to the primary winding 81 from a power source 84 (nodes (4), (7)).

In this context, when soldering is used for the method of electrically connecting the secondary windings 82, 83 formed in two parts, the connection sections 85, 86, 87, and 88 should resist the melting temperature of solder, and thus providing a metallic terminal on each of the connection sections 85 to 88 is a possible method. However, dividing the secondary winding into two parts performs half the voltage generated at each of the high voltage side ends of the secondary windings; thus, even the insulation structure, which is difficult with respect to the high voltage at the high voltage output terminal generated by a secondary winding having one winding on one side, can be constructed with a simple structure by virtue of the fact that the voltage at each of terminals is reduced in the embodiment. For example, when one portion of the member for the primary winding formed of a printed circuit board is provided with projecting connection sections 85, 86 for entwining the high voltage ends of the secondary winding divided into two parts, the high voltage output terminals of the secondary winding having a sufficient withstand voltage and heat resistance with a simple structure can be formed.

Figure 19:
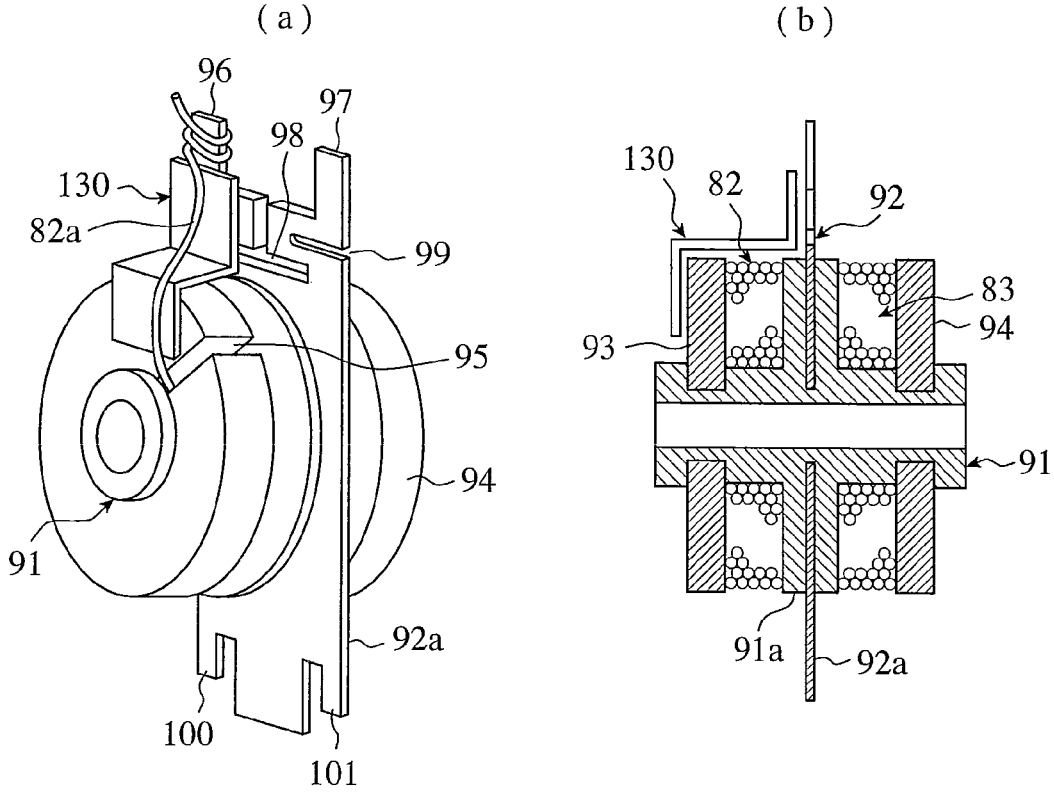
FIG. 19 (*a*) is a perspective external view of a modification of the sixth embodiment, and FIG. 19 (*b*) is a cross-sectional view thereof.

FIG. 19 (*a*) and FIG. 19 (*b*) show an external perspective view and a cross-sectional view of a modification in the sixth embodiment, respectively.

The transformer of the sixth embodiment is the one where the secondary winding is arranged to output the two half voltages having opposite polarities, and high withstand voltage properties resisting the voltages at the high voltage portion and the low voltage portion can be secured by the following procedures. The structures of the primary winding and the secondary winding are the same as those shown in FIG. 17 and FIG. 18; however, in FIG. 19 (*a*) and FIG. 19 (*b*), a bobbin is shown in addition to the structures thereof. As shown in FIG. 19 (*a*) and FIG. 19 (*b*), a primary winding 92 is integrally embedded in the mid-portion of a bobbin 91 cylindrical in the central portion. Plate cores 93, 94 constituting part of the bobbin 91 are fixed on the bobbin 91, and opposed to the embedded section 91*a* of the primary winding 92 in the bobbin 91. Each of the plate cores 93, 94 is provided with a slit 95 for leading the winding therethrough. FIG. 19 (*a*) shows only the slit 95 on the side of the plate core 93; however, the other plate core 94 is similarly provided with a slit formed therethrough.

A printed circuit board 92*a* that is the structural member of the primary winding 92 is provided with radially outwardly projecting connection sections (entwining sections) 96, 97 clad with copper foil (corresponding to the connection sections 85, 86 shown in FIG. 17). The connection section 96, 97 are formed in a zigzag form with slots 98, 99 that are alternately provided from the end such that the creeping distance thereof is increased. Further, the printed circuit board 92*a* is provided with radially outwardly projecting connection sections 100, 101 clad with a copper foil (corresponding to the connection sections 87, 88 shown in FIG. 17).

The space between the primary winding embedded portion 92*a* and each of the plate cores 93, 94 is provided with a secondary winding formed by winding a conductor wire (copper wire or the like) as in the example shown in FIG. 17. In other words, the secondary winding is formed in a separated manner into two halves with the primary winding as a boundary.

A crank insulating plate 130 is provided over the outer surface of the plate core 93 and the vicinity of the primary winding 92. The end 82*a* of the secondary winding (corresponding to the secondary winding shown in FIG. 17) on the low voltage side is radially outwardly led along the insulating plate 130, and is wound about the connection section 96 formed on the printed circuit board 92*a* that is the structural member of the primary winding 92. It should be understood that after thus constructing the sheet type transformer, the high voltage portion containing the secondary winding and the portion thereof entwined about the connection section 96 or the whole of the sheet type transformer may be embedded in and insulated with a resin.

According to the sheet type transformer of the embodiment, the end 82*a* on the high voltage side of the secondary winding is led to the connection section 96 with the insulating plate 130 interposed therebetween, and thus the insulation between the high voltage side and the low voltage side in the secondary winding can be secured. Furthermore, the connection section 96 is formed in a zigzag form and thereby the creeping distance between the primary winding 92 and the connection section can be secured. Thus, the insulation therebetween can also be obtained.

Figure 20:
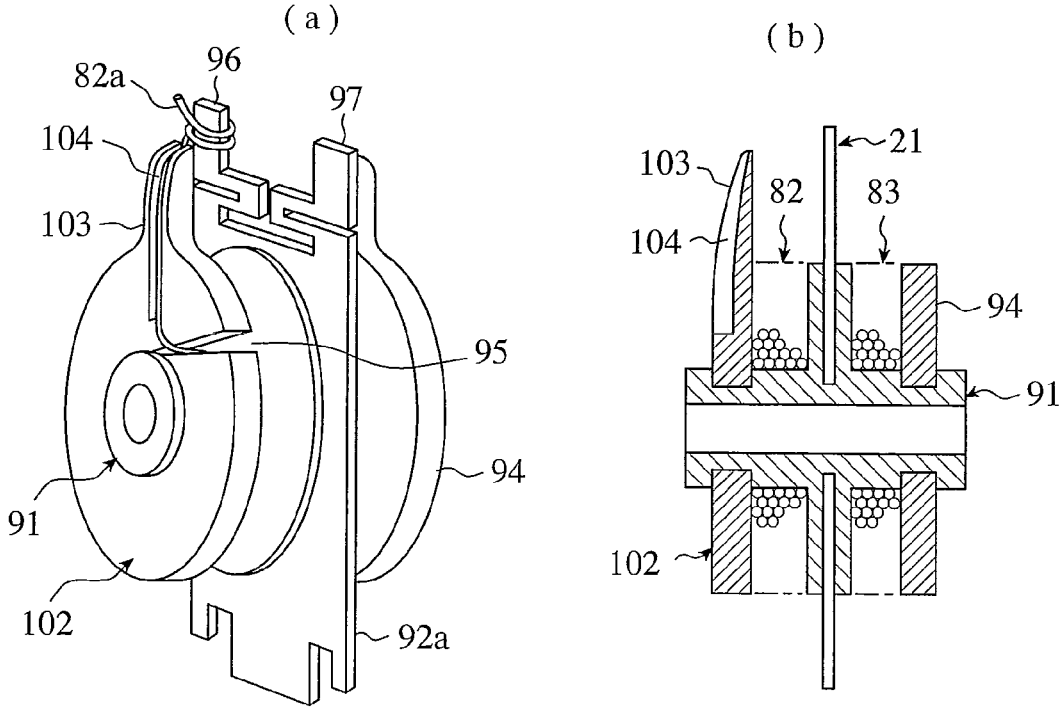
FIG. 20 (*a*) is a perspective external view of another modification of the sixth embodiment, and FIG. 20 (*b*) is a cross-sectional view thereof.

FIG. 20 (*a*) and FIG. 20 (*b*) show a perspective external view and a longitudinal cross-sectional view of a modification of the sheet type transformer shown in FIG. 19 (*a*) and FIG. 19 (*b*), respectively. The plate core 102 integrally formed on the bobbin 91 is provided with a guide 103 radially projecting therefrom and the guide 103 is provided with a groove 104. The end 82*a* on the high voltage side of the secondary winding is housed in the groove 104 of the guide 103 in the plate core 102, and led to the connection section 96.

According to the sixth embodiment, the plate core 102 is integrally provided with the guide 103, and thus the number of parts can be reduced. Moreover, the guide 103 is provided with the groove It should be noted that in FIG. 9, FIG. 15, FIG. 16, FIG. 17, and FIG. 18, the primary winding and the secondary winding are connected to each other for purposes of convenience; however, they may each have an insulating configuration independent from each other.

Seventh Embodiment

Figure 21:
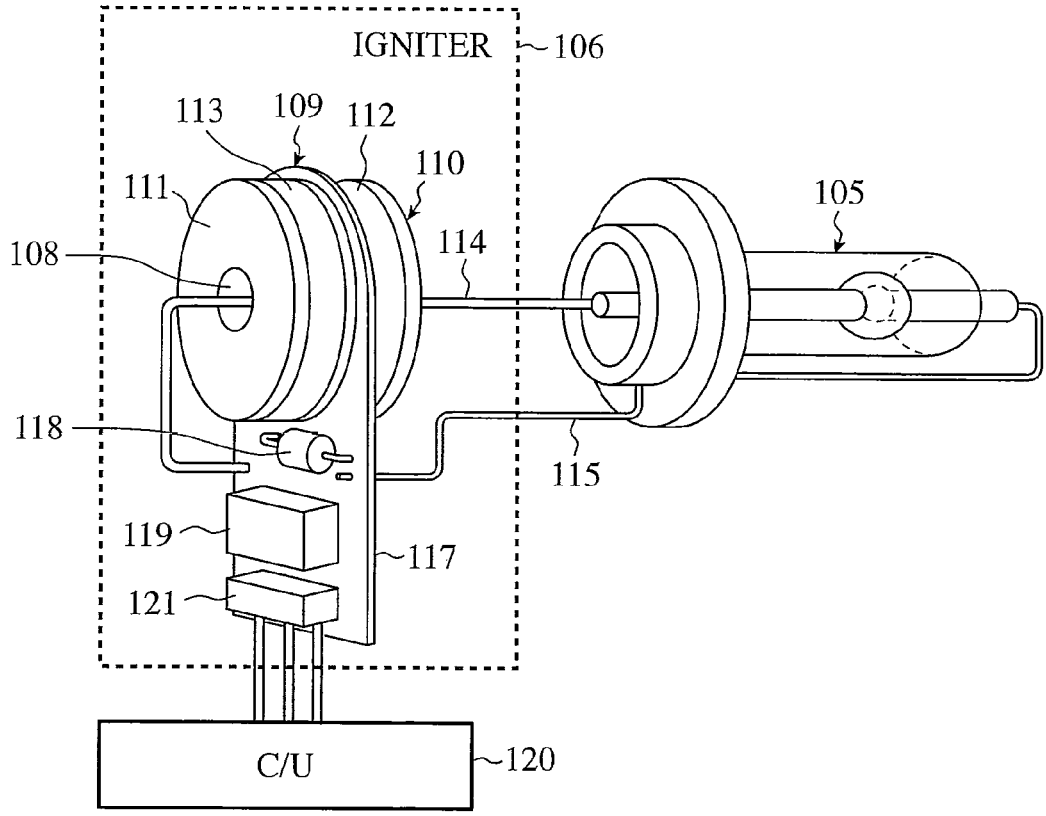
FIG. 21 is a schematic view of a discharge lamp of the seventh embodiment.
Figure 22:
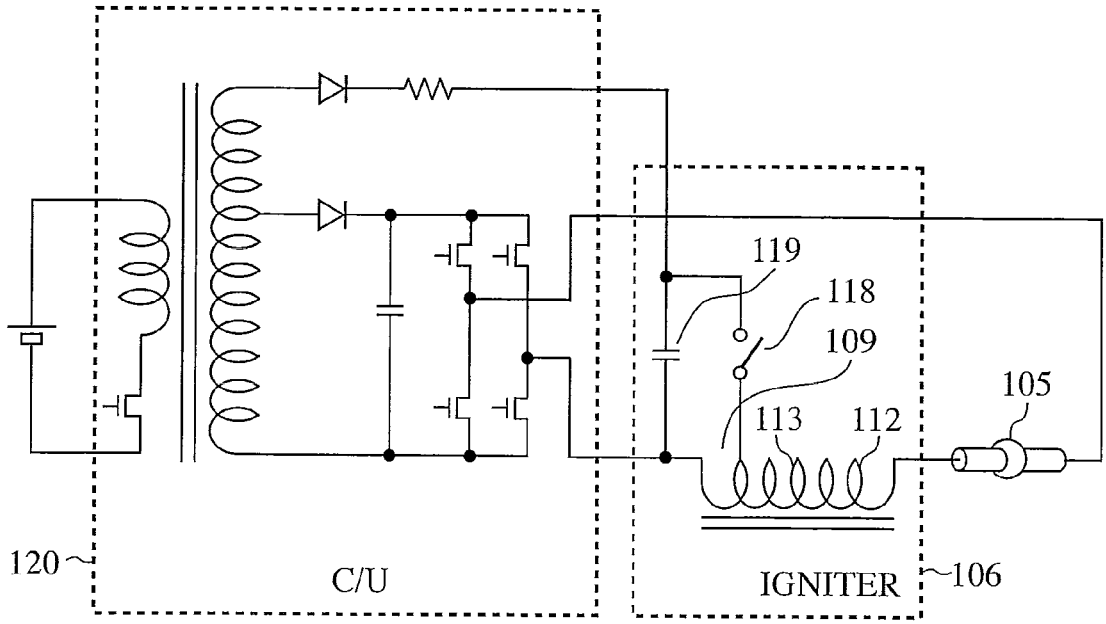
FIG. 22 is a circuit diagram of the seventh embodiment.

FIG. 21 and FIG. 22 show an example of a discharge lamp apparatus where a sheet type transformer according to the present invention is applied to an igniter 106 of a discharge lamp 105 (HID bulb). FIG. 21 is a schematic configuration diagram of the discharge lamp apparatus, and FIG. 22 is the circuit diagram thereof. The above-described sheet type transformer is used as a sheet type transformer 107. Specifically, the sheet type transformer is composed of a primary winding 109 formed integral with a bobbin 108, plate cores 110, 111, and secondary windings 112, 113 formed between the primary winding 109 and the plate cores 110, 111. The output ends 114, 115 of the sheet type transformer 107 are connected with the HID bulb 105. A wiring board 117 that is a structural member of the primary winding 109 in the sheet type transformer 107 is provided with a GAP switch 118 and a capacitor 119 constituting portion of the igniter 106. The wiring board 117 is also provided with a connector 121 for connecting a control circuit (C/U) 120 thereto. The GAP switch 118 and the capacitor 119 constitute the high-voltage pulse generation circuit of the primary winding 109.

It should be understood that a discharge lamp having connection connectors is used for explanation for purposes of convenience; however, the output ends 114, 115 may be connected directly to the terminals of a discharge lamp having no connector.

According to the seventh embodiment, components constituting the igniter 106 are arranged to be disposed on the wiring board of the primary winding 109. Thus, the necessity of a dedicated substrate board where electronic parts are mounted or connected can be eliminated, the overall apparatus can be reduced in size, and besides the production cost thereof can be also reduced.

INDUSTRIAL APPLICABILITY

As mentioned hereinabove, the sheet type transformer according to the present invention is a small-sized sheet type transformer capable of securing high insulating properties and resisting high voltage by drawing out the end on the high voltage side of the secondary winding from the central side in the radial direction with a simple structure without damaging the thinness thereof, and thus the transformer is suitable for use in sheet type transformers used within a discharge lamp lighting apparatus.

The invention claimed is:

1. A sheet type transformer comprising:

a primary winding formed in the shape of a flat plate;

a secondary winding comprising a conductor wire wound about an axis perpendicular to a face of the primary winding;

a central core located in the center of the primary winding and the secondary winding; and a magnetic member, into which the central core is inserted, located externally of the primary winding and the secondary winding and having a plane larger than the external diameter of the central core, wherein, from the center of the secondary winding in the radial direction, the conductor wire is drawn out through a drawing section provided for the magnetic member in a direction perpendicular to the face of the primary winding, and the magnetic member includes a plate core of non-uniform thickness, the thickness of the plate core varying in at least approximate correspondence with a distribution of magnetic flux generated bathe primary winding.

2. The sheet type transformer according to claim 1 wherein the conductor wire drawn out from the center of the secondary winding is connected to an output terminal adjacent to the central core.

3. The sheet type transformer according to claim 1 wherein the primary winding is provided by forming a conductive flat plate in a spiral fashion.

4. The sheet type transformer according to claim 1 wherein the primary winding is provided by forming a metal foil in a spiral fashion on a printed circuit board.

5. The sheet type transformer according to claim 1 wherein the primary winding is embedded within a resin bobbin having the secondary winding wound thereon.

6. The sheet type transformer according to claim 5 wherein the primary winding is embedded within a portion serving as a partition dividing the secondary winding into a plurality of parts in the bobbin having the divided secondary winding wound thereon.

7. The sheet type transformer according to claim 1 wherein the magnetic member is embedded in whole or in part within the bobbin.

8. The sheet type transformer according to claim 1 wherein a spool having the secondary winding wound thereon is formed by the magnetic member.

9. The sheet type transformer according to claim 1 wherein resin into which magnetic powder is incorporated is used for the magnetic member.

10. The sheet type transformer according to claim 1 wherein the magnetic member is provided with a groove disposed radially outwardly from a drawing-out section provided therethrough to axially outwardly draw out the end of the secondary winding on the radially central side of the winding.

11. The sheet type transformer according to claim 6 wherein the direction of winding the secondary winding is reversed between the portion of the secondary winding located on one side of the primary winding and the portion of the secondary winding located on the other side thereof, the low voltage end of the secondary winding on the low voltage side and the high voltage end of the secondary winding on the high voltage side are disposed on the respective radially central sides of the secondary winding, and in the section where the primary winding is disposed, the high voltage end of the secondary winding on the low voltage side and the low voltage end of the secondary winding on the high voltage side are connected to each other.

12. The sheet type transformer according to claim 11 wherein the member constituting the primary winding is provided with a connection section where the high voltage end of the secondary winding on the low voltage side and the low voltage end of the secondary winding on the high voltage side are connected to each other.

13. The sheet type transformer according to claim 6 wherein the respective ends of the portions of the secondary winding which are drawn out to the radially central sides of the portions of the secondary winding positioned on both sides of the primary winding serve the function of the output terminals thereof on the high voltage sides the polarities of which are different from each other, and the respective ends of the portions of the secondary winding which are drawn out from the outer peripheral sides thereof serve the function of the input terminals thereof on the low voltage sides.

14. The sheet type transformer according to claim 11 wherein the member constituting the primary winding is provided with a connection section for having connected thereto the end on the low voltage side of the secondary winding.

15. The sheet type transformer according to claim 13 wherein the member constituting the primary winding is provided with a connection section for having connected thereto the end on the high voltage side of the secondary winding.

16. A discharge lamp lighting apparatus wherein the sheet type transformer according to claim 1 is used for a transformer for generating a high-voltage pulse to start up a discharge lamp.

17. The discharge lamp lighting apparatus according to claim 16 wherein the member constituting the primary winding is provided with a high-voltage pulse generation circuit.

* * * * *